United States Patent [19]

Smith

[11] Patent Number: 5,052,969

[45] Date of Patent: Oct. 1, 1991

[54] DOLL WITH HEAD TILT ACTIVATED LIGHT

[75] Inventor: Robin K. Smith, Long Beach, Calif.

[73] Assignee: Mattel, Inc., El Segundo, Calif.

[21] Appl. No.: 496,563

[22] Filed: Mar. 20, 1990

[51] Int. Cl.[5] ..... A63H 3/00; A63H 3/36; A63H 33/26

[52] U.S. Cl. ..... 446/268; 446/338; 446/485

[58] Field of Search ..... 446/268, 338, 384, 391, 446/485, 484, 334, 365, 372, 330; 362/806, 8.8, 8.1

[56] References Cited

U.S. PATENT DOCUMENTS

| | | | |
|---|---|---|---|
| 1,300,361 | 4/1919 | Edelman | 446/485 X |
| 1,773,834 | 8/1930 | Wilson | 446/485 X |
| 2,334,290 | 11/1943 | Richter | 446/365 X |
| 2,605,385 | 7/1952 | Levinson | 446/485 |
| 2,744,189 | 5/1956 | Wudyka | 446/485 X |
| 2,764,841 | 10/1956 | Birnbaum | 446/365 |
| 2,794,298 | 6/1957 | Mason | 446/485 X |
| 2,959,892 | 11/1960 | Johnson | 446/485 X |
| 3,229,421 | 1/1966 | Ostrander | 446/304 |
| 3,383,795 | 5/1963 | Ryan et al. | 446/304 |
| 3,406,482 | 10/1968 | Ryan et al. | 446/304 |
| 3,456,950 | 7/1969 | Goldfarb | 446/391 X |
| 3,475,853 | 11/1969 | Adler | 446/330 |
| 3,514,899 | 6/1970 | Bonanno et al. | 446/298 |
| 3,724,125 | 4/1973 | Goldfarb et al. | 446/330 |
| 3,858,352 | 1/1975 | Cummings et al. | 446/338 X |
| 3,900,992 | 8/1975 | Klammer | 446/330 |
| 3,918,199 | 11/1975 | De Masi | 446/301 |
| 4,033,071 | 7/1977 | Strogin et al. | 446/177 |
| 4,074,460 | 2/1978 | Thorn et al. | 446/304 |
| 4,276,714 | 7/1981 | Albert et al. | 446/300 |
| 4,324,054 | 4/1982 | Rovinsky | 446/485 X |
| 4,356,928 | 11/1982 | Stafford | 220/73 |
| 4,516,951 | 5/1985 | Saigo et al. | 446/338 |
| 4,595,379 | 6/1986 | Rasmussen et al. | 446/341 |
| 4,717,363 | 1/1988 | Refabert | 446/14 |
| 4,836,823 | 6/1989 | Laven | 446/485 |

FOREIGN PATENT DOCUMENTS

| | | | |
|---|---|---|---|
| 1082172 | 5/1960 | Fed. Rep. of Germany | 446/384 |
| 1056370 | 1/1967 | United Kingdom | 446/384 |
| 2185897 | 8/1967 | United Kingdom | 446/485 |

*Primary Examiner*—Robert A. Hafer
*Assistant Examiner*—D. Neal Mair
*Attorney, Agent, or Firm*—Roy A. Ekstrand

[57] ABSTRACT

A toy doll having a kiss activated play feature includes a doll having a torso, arm and leg appendages, and a head pivotally secured by a neck extension to the torso. A plurality of sparkle elements are supported on the doll exterior and an electronic energizing circuit for the sparkle elements is supported within a cavity located in the doll torso. The head is supported by a neck extension in a pivotal attachment in which a switch supported within the torso is actuated by backward motion or tilting of the doll head with respect to the torso. A return spring is provided which urges the head to a vertical position and which resists the backward tilting of the head. The child actuates the flashing of the sparkle elements by kissing or caressing the face or frontal area of the doll head with sufficient force to overcome the spring and tilt the head back a sufficient distance to actuate the flashing switch.

8 Claims, 1 Drawing Sheet

DOLL WITH HEAD TILT ACTIVATED LIGHT

FIELD OF THE INVENTION

This invention relates generally to toy dolls and particularly to dolls having additional play features.

BACKGROUND OF THE INVENTION

To increase the play and entertainment value of toy dolls or the like, practitioners in the art have provided a great variety of additional play features for dolls beyond that found in their physical resemblance to human infants. In recent years, a variety of battery powered activities have been utilized in dolls and the like.

U.S. Pat. No. 3,229,421 issued to Ostrander sets forth POWER OPERATED DOLLS in which a DC motor within the doll body is operated in response to battery powered and electrical contacts supported within a simulated baby bottle. The motor is activated by insertion of the bottle into the doll's mouth to complete the circuit for the DC motor and produce movement of the doll's limbs in response to the bottle presence.

U.S. Pat. No. 3,383,795 issued to Ryan et al. sets forth a MECHANISM FOR SIMULATING INGESTION IN A FIGURE TOY in which electrical means are provided by which the facial muscles and eyes of the doll are moved in response to the insertion of a bottle nipple to simulate ingestion of the bottle's contents.

U.S. Pat. No. 3,406,482 issued to Ryan et al. sets forth a FACIAL ANIMATING MEANS FOR A TOY FIGURE in which motor operated articulating means within the doll are operated in response to the insertion of a simulated bottle into the doll mouth. The articulation of facial cheeks and eyes are coordinated to provide the desired animation.

U.S. Pat. No. 3,475,853 issued to Adler sets forth a DOLL HEAD MOVABLE AS A RESULT OF MOVEMENT OF ANOTHER DOLL BODY PART in which a doll is provided with a mechanical linkage mechanism supported within the doll torso and coupled between the doll head and arms to provide head motion in response to arm motion in the doll.

U.S. Pat. No. 3,514,899 issued to Bonanno et al. sets forth a DOLL HAVING ELECTRICAL ACTION PRODUCING MECHANISM RESPONSIVE to ACTUATOR ON SEPARATE ARTICLES in which the doll limbs are articulated in response to internal motor driven articulation means. A switch mechanism within the doll mouth is operative to the insertion of a simulated bottle to trigger the motion of the doll limbs.

U.S. Pat. No. 3,724,125 issued to Goldfarb et al. sets forth a PUSH BUTTON DOLL in which a doll body supports separate movable limbs and head. A spring loaded button is accessible from the front of the doll and means such as strings connect each of the limbs and head to the button. When the button is activated, the limbs are moved in response to the energy stored within the spring.

U.S. Pat. No. 3,900,992 issued to Klamer sets forth a DOLL HAVING LIMBS WITH HEMISPHERICAL PORTIONS PIVOTALLY JOINED TO ITS BODY in which a toy figure includes a body supporting movable head and arms. The arms are connected to a common shaft extending through the body and the head includes a lower extension which extends into the hollow body and contacts a portion of the arm shaft causing the arms to move when the head is turned.

U.S. Pat. No. 3,918,199 issued to DeMasi sets forth a DOLL SIMULATING NATURAL SUCKING MOTION AND CONTROL DEVICE FOR SAME in which a doll formed of an elastically deformable material includes a hollow head and chest. A motor supported within the body reciprocates a linkage for reciprocal deformation of the mouth and adjacent face portions of the doll face to simulate sucking motion when a contact bearing simulated bottle is inserted into the doll's mouth. Additional sound means are provided which produce corresponding nursing sounds during facial motion.

U.S. Pat. No. 4,033,071 issued to Strongin et al. sets forth a SUCKING DOLL WITH CHEEKFLEXING MEANS OPERATED BY TURNING BOTTLE in which a doll adapted for simulated drinking activities includes an internal linkage mechanism coupled to the doll's movable eyes and cheek portions. A rotatable shaft is coupled to the articulation system and couples to an inserted simulated bottle. Thereafter, rotation of the simulated bottle causes a corresponding rotation of the coupling shaft and the articulation of the doll's eyes and cheek portions.

U.S. Pat. No. 4,074,460 issued to Thorn et al. sets forth a DOLL SIMULATING SUCKING ACTION in which a doll includes an operating mechanism actuated by a simulated baby bottle inserted into the doll's mouth. The mechanism is operative in response to rotation of the inserted bottle.

U.S. Pat. No. 4,276,714 issued to Albert et al. sets forth a DOLL INCLUDING MECHANISM FOR SUCKING ACTION AND SOUNDS in which a doll includes a body and movable head having a mouth opening formed therein. A drive mechanism is contained within the doll's body for oscillating the head in a forward to back direction in response to the insertion of a simulated bottle. Associated sound producing means are provided.

U.S. Pat. No. 4,595,379 issued to Rasmussen et al. sets forth A BOTTLE DRIVEN ARTICULATED DOLL in which a toy doll includes arms and legs mounted for pivotal movement to a torso. Linkage means are provided which produce motion of the arms and legs in response to the rotation of an inserted simulated bottle in the doll'mouth.

U.S. Pat. No. 4,717,363 issued to Refabert sets forth DOLLS OR SIMILAR TOYS in which a doll is equipped with a voice unit and electrical battery power therefor. The voice unit is configured to emit sounds simulating crying. A heat detector in the doll cheek detects proximity of the child's cheek and produces a corresponding sound emission.

U.S. Pat. No. 4,356,928 issued to Stafford sets forth a DECORATIVE ARTICLE CONTAINING FOWL in which a decorative simulated fowl includes an internal compartment for receiving articles. The internal compartment is provided with a covering formed by the fowl's wings and articulation means are provided whereby the wings move between opened and closed position in response to rotation of the fowl's head.

While the foregoing described toy dolls provide varied play action and increased amusement beyond that found in simple unfeatured dolls, there remains a neverending need in the art for toy dolls having additional different play features to maintain the highest amusement and entertainment value of dolls.

SUMMARY OF THE INVENTION

Accordingly, it is a general object of the present invention to provide an improved toy doll. It is a more particular object of the present invention to provide an improved toy doll which includes play features heretofore not realized in toy dolls.

In accordance with the present invention, there is provided a doll comprises: a head having a neck and face portion; a torso; attachment means pivotally coupling the head to the torso; limit means limiting the pivotal motion of the head with respect to the torso to a predetermined angular range; feature means for producing a play response in the doll; and switch means coupled to the feature means and actuated by pivotal motion of the head with respect to the torso, the feature means producing the play response when the switch means are actuated.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
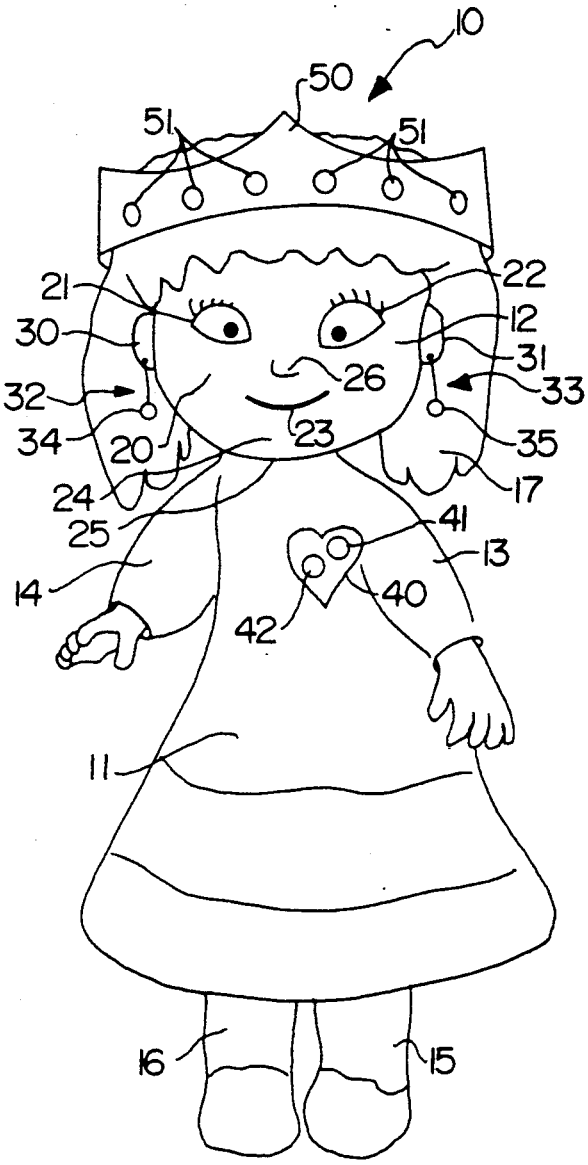
FIG. 1 sets forth a front view of a toy doll constructed in accordance with the present invention.

FIG. 1 sets forth a front view of a doll constructed in accordance with the present invention and generally referenced by numeral 10. Doll 10 includes a torso 11, a left arm 13 and a right arm 14. A left leg 15 and a right leg 16 are also secured to torso 11. Doll 10 further includes a simulated head 12 having a doll face 20 having eyes 21 and 22, a nose 26, a mouth 23 and a chin 24. A right ear 30 and left ear 31 extend outwardly on either side of face 20 and support a pair of earrings 32 and 33 respectively. A quantity of simulated hair 17 is secured to head 12 and extends downwardly behind ears 30 and 31. A tiara 50 is secured to head 12 overlying a portion of hair 17 and supports a plurality of sparkle elements 51. An additional pair of sparkle elements 34 and 35 are supported within earrings 32 and 33 respectively. A decorative brooch 40 is secured to torso 11 and supports a pair of sparkle elements 41 and 42. By means set forth below in greater detail, sparkle elements 51 in tiara 50, sparkle elements 34 and 35 in earrings 32 and 33, and sparkle elements 41 and 42 in brooch 40 are commonly coupled to an energizing circuit which operates in accordance with the present invention to provide rapid blinking and short duration light output signals to produce a flashing or shimmering effect in accordance with the sparkle feature of doll 10.

In operation, with head 12 positioned in its normal upright position as shown in FIG. 1, sparkle elements 51, 34, 35, 41 and 42 remain inoperative and no flashing light output is produced. In accordance with the invention, the various sparkle elements are energized in response to play actions in which torso 11 is maintained static and which cause head 12 to be tilted backwardly. In its preferred use, the backward tilting of head 12 is produced by the child's play action in which the child kisses doll 10 at virtually any place on face 20. As soon as the child carries forward the play action of holding torso 11 and kissing face 20, the corresponding backward head motion produced by means set forth below in greater detail energizes the circuitry which powers the sparkle element of doll 10 causing the flashing or shimmering effect.

Thus, an enhanced play value is provided by the present invention doll in which the child activates the shimmering or flashing sparkle feature of the doll by simply kissing the doll. While the sparkle element energizing circuitry is responsive to backward head motion of head 12 with respect to torso 11 regardless of the manner in which it is caused, the appearance given the child is that the sparkle element flashing occurs in response to kisses of the child upon the doll's face.

Figure 2:
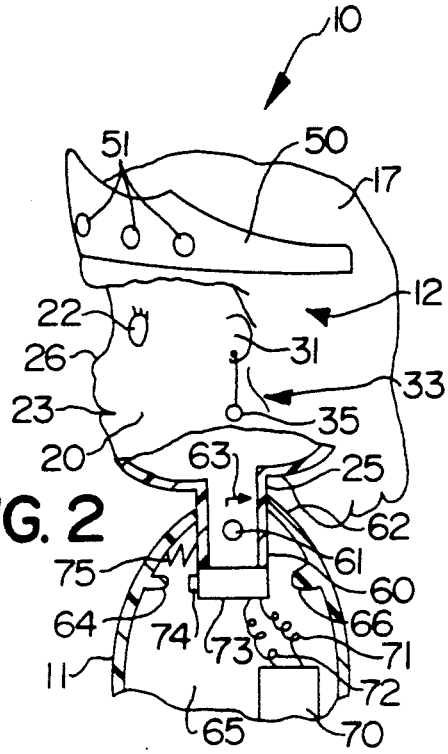
FIG. 2 sets forth a partial section view of the present invention toy doll.

FIG. 2 sets forth a partial section view of doll 10 showing the activating mechanism for energizing the doll's sparkle elements. As mentioned above, doll 10 includes a head 12 supported by a neck 25. A quantity of hair 17 is secured to head 12 by conventional means. A tiara 50 is secured to head 12 and supports a plurality of sparkle elements 51. Head 12 further includes a face 20, a mouth 23, a nose 26, an eye 22 and an ear 31. An earring 33 is attached to ear 31 and includes a sparkle element 35. Doll 10 further includes a torso 11 having an internal cavity 65 and defining a neck aperture 62. Neck 25 further includes a neck extension 60 extending downwardly through aperture 62 and secured to torso 11 by a pivot 61. Torso 11 further defines an inwardly extending switch actuator 64 and an inwardly extending limit stop 66. A switch 73 is secured to the lower end of neck extension 60 and supports a switch button 74 which is aligned with switch actuator 64. A flashing circuit 70 includes an internal source of battery power and an electronic circuit producing an output signal utilized to flash sparkle elements 51, 34 and 35, and 41 and 42 in response to actuation of switch 73. While not shown in FIG. 2, it should be understood that a plurality of electrical connections are coupled between sparkle elements 51, 34 and 35, and 41 and 42 to couple them to flashing circuit 70.

A spring 75 is captivated between the interior wall of torso 11 and neck extension 60 to maintain the upright position of head 12 shown in FIG. 2 and to maintain a separation between switch actuator 64 and button 74 of switch 73. In the position shown in FIG. 2, spring 75 maintains the above-described separation and head 12 is maintained in the vertical position. Thus, switch 73 is not closed and flashing circuit 70 is inactive. As a result, the sparkle elements on doll 10 remain similarly inactive.

In the event, however, the child playing with doll 10 carries forward the play action corresponding to kissing or otherwise caressing face 20 of doll 10, the force applied to face 10 overcomes the force of spring 75 and causes head 12 to pivot backwards about pivot 61. The pivotal motion of head 12 about pivot 61 produces a corresponding pivotal motion of neck extension 60 and switch 73 which moves button 74 into contact with switch actuator 64. Once head 12 is pivoted backward in response to the child's play action a sufficient distance to bring button 74 into contact with switch actuator 64, switch 73 is closed and this closed condition is coupled to flashing circuit 70 by connecting wires 71 and 72. The closed condition of switch 73 activates flashing circuit 70 producing the above-described flashing or shimmering of the sparkle elements of doll 10. While not shown in detail it should be understood that, in its preferred embodiment, flashing circuit 70 includes a delay timer which carries forward the flashing or shimmering action of sparkle elements on doll 10 for a predetermined time interval in response to each actuation of switch 73. Thus in the preferred mode, flashing circuit 70 maintains the flashing or shimmering of the sparkle elements on doll 10 for the predetermined time interval notwithstanding the return of head 12 to its vertical position. As a result, each time the child playing with doll 10 holds torso 11 and caresses face 20 or other frontal portions of head 12, a corresponding rotation or pivotal motion of head 12 is produced which once again actuates flashing circuit 70. While the spring force of spring 75 which must be overcome to cause the above-described pivotal motion of head 12 may be selected in accordance with design preference, it has been found desirable to select the spring force of spring 75 to be sufficient to overcome the pivoting action of head 12 caused by gravity in the event doll 10 is placed in a prone horizontal position. Thus when so selected, spring 75 precludes the operation of the sparkle elements upon doll 10 in response to placing doll 10 in a horizontal position.

Figure 3:
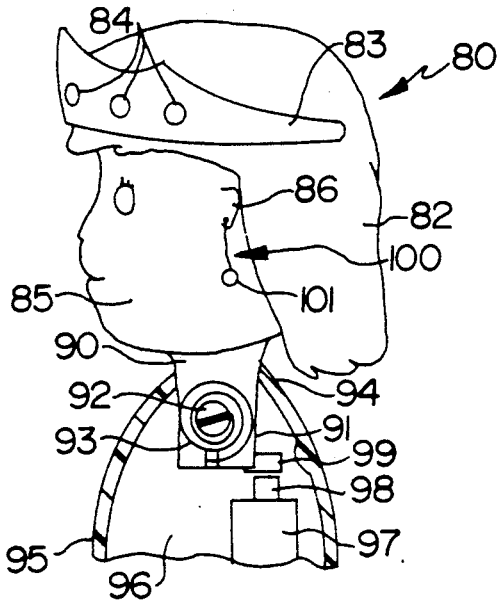
FIG. 3 sets forth a partial section view of an alternate embodiment of the present invention toy doll.

FIG. 3 sets forth an alternate embodiment of the present invention doll generally referenced by numeral 80. Doll 80 includes a head 81 supporting a quantity of simulated hair 82. A tiara 83 is secured to head 81 and supports a plurality of sparkle elements 84. Head 81 further defines a face 85 similar to face 20 having similar anatomical features thereon. Head 81 further defines an ear 86 which supports an earring 81. Earring 81 in turn supports a sparkle element 101. A neck 90 extends downwardly from head 81 and terminates in a downwardly extending neck extension 91.

A torso 95 similar to torso 11 shown in FIG. 2 defines an internal cavity 96 and neck aperture 94. Neck 90 and neck extension 91 extend downwardly through neck aperture 94 and are supported by a pivotal attachment 92 extending inwardly from torso 95. Pivot 92 further includes a return spring 93 coiled about pivot 92 and secured to neck extension 91 such that a counterclockwise force is applied to neck 90 forcing head 81 to the upright position shown in FIG. 3. A switch activating member 99 extends laterally from the lower end of neck extension 91 and is movable in conjunction with pivotal motion of neck extension 91.

A flashing circuit 97 includes an internal battery power system for flashing the sparkle elements such as sparkle elements 84 and 101 of doll 80 as well as a plurality of electrical connecting wires (not shown) which couple flashing circuit 97 to each of the sparkle elements within doll 80. A switch 98 is supported upon and coupled to flashing circuit 97 and is interposed between switch activator 99 and flashing circuit 97. As a result, pivotal motion of head 81 in a rearward or tilting back direction causes a pivoting force upon neck extension 91 which overcomes the return force of spring 93 and which pivots the lower end of neck extension 91 about pivot 92 in a clockwise direction. The pivotal motion of neck extension 91 in turn forces switch activator 99 against switch 98 causing an electrical connection within flashing circuit 97 and producing the above-described flashing or shimmering of the sparkle elements within doll 80. Thus in accordance with the above-described play activity by the child using doll 80, the child grasps torso 95 and kisses or caresses face 85 or other frontal portions of head 81 with sufficient force to pivot head 81 backwardly and actuate switch 98 inducing flashing circuit 97 to produce the flashing or shimmering effect of the sparkle elements of doll 80.

What has been shown is an improved play activity doll having a play feature which simulates actuation of the play feature in response to the kissing or caressing of the child by the child user. The feature shown provides a novel play feature not heretofore achieved in toy dolls and which provides substantial increase in the amusement and entertainment value thereof.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. A doll having a kiss-activated play feature comprising:

a head having a neck and face portion;

a torso;

attachment means pivotally coupling said head to said torso such that said head pivots backward with respect to said torso when a user pivots said head backwards about an axis perpendicular to said torso;

limit means limiting the pivotal motion of said head with respect to said torso to a predetermined angular range;

feature means for producing a lighted play response in said doll; and switch means coupled to said feature means and actuated by pivotal motion of said head with respect to said torso, spring means to return said head forwardly and deactuate said switch means;

said feature means producing said play response when said switch means are actuated.

2. A doll as set forth in claim 1 further including a plurality of electrically operated sparkle elements and electrical circuit means operative to operate said sparkle elements and wherein said play response includes the rapid flashing of said sparkle elements to produce flashing light.

3. A doll as set forth in claim 2 wherein said torso defines an internal cavity and an upwardly facing neck aperture and wherein said neck includes an elongated neck extension extending through said neck aperture.

4. A doll as set forth in claim 3 wherein said attachment means are supported within said interior cavity of said torso.

5. A doll as set forth in claim 4 wherein said neck extension defines an outwardly extending pin and wherein said torso includes a socket receiving said pin, said pin and said socket defining said attachment means.

6. A doll as set forth in claim 5 wherein said spring means include a coil spring wound upon said pin and exerting a pivotal force between said neck extension and said torso.

7. A doll as set forth in claim 4 wherein said neck extension defines an aperture and wherein said torso includes a pin supported therein and extending through said aperture, said pin and said aperture defining said attachment means.

8. A doll as set forth in claim 7 wherein said spring means includes an expandable spring captivated between said neck extension and said torso.

* * * * *